US006315809B1

(12) United States Patent
Morita et al.

(10) Patent No.: US 6,315,809 B1
(45) Date of Patent: Nov. 13, 2001

(54) MOLDING POWDER FOR CONTINUOUS CASTING OF THIN SLAB

(75) Inventors: Akihiro Morita; Tomoaki Omoto, both of Okayama (JP)

(73) Assignee: Shinagawa Refractories Co., Ltd., Tokyo (JP)

( * ) Notice: Subject to any disclaimer, the term of this patent is extended or adjusted under 35 U.S.C. 154(b) by 0 days.

(21) Appl. No.: 09/508,117

(22) PCT Filed: Jul. 16, 1999

(86) PCT No.: PCT/JP99/03385

§ 371 Date: Mar. 21, 2000

§ 102(e) Date: Mar. 21, 2000

(87) PCT Pub. No.: WO00/05012

PCT Pub. Date: Feb. 3, 2000

(30) Foreign Application Priority Data

Jul. 21, 1998 (JP) ..... 10-205121

(51) Int. Cl.[7] ..... C21B 3/00
(52) U.S. Cl. ..... 75/305; 75/252
(58) Field of Search ..... 75/305, 252

(56) References Cited

U.S. PATENT DOCUMENTS 3,899,324 * 8/1975 Corbett .
4,092,159 * 5/1978 Uher ..... 75/257
4,594,105 * 6/1986 Grimm et al. ..... 75/257
4,842,647 * 6/1989 Ichikawa et al. ..... 106/38.2
5,234,488 * 8/1993 Ichikawa et al. ..... 75/305
5,876,482 * 3/1999 Debiesme et al. ..... 75/305
6,125,919 * 10/2000 Hanao et al. ..... 164/472

FOREIGN PATENT DOCUMENTS 2-25254 * 1/1990 (JP) .
2-165853 * 6/1990 (JP) .
3-8544 * 1/1991 (JP) .
10-258343 * 9/1998 (JP) .

* cited by examiner

*Primary Examiner*—Ngoclan Mai
(74) *Attorney, Agent, or Firm*—Oblon, Spivak, McClelland, Maier & Neustadt, P.C.

(57) ABSTRACT

A mold powder characterized in that, a weight ratio of CaO to $SiO_2$ in the mold powder is within a range of 0.50 to 1.20, the mold powder contains one or two or more species selected from a group consisting of oxides, carbonates, or fluorides of alkali metals, alkaline earth metals, or other metals, and 0.5 to 5 percent by weight of carbon powder, $Li_2O$ content is within a range of 1 to 7 percent by weight, F content is within a range of 0.5 to 8.0 percent by weight, crystallization temperature is within a range of 1000 to 1200° C., surface tension at 1300° C. is 250 dyne/cm or more, and a relationship between viscosity η (poise) at 1300° C. and casting speed V (m/min) satisfies a range represented by an expression $6.0 \leqq \eta V \leqq 100.0$. By the present invention, there is provided a mold powder which enables stable casting by reducing the likelihood of powder entrapment into the mold without giving rise to surface crack when casting with a thin-slab continuous caster.

14 Claims, No Drawings

MOLDING POWDER FOR CONTINUOUS CASTING OF THIN SLAB

TECHNICAL FIELD OF THE INVENTION

The present invention relates to a mold powder for continuous casting of thin slabs having a slab thickness of 150 mm or less.

RELATED ART

Mold powders for continuous casting of steel generally have Portland cement, synthetic calcium silicate, wollastonite, phosphorus-containing slag, etc., as their principal raw materials, and where required, silica materials may be added, soda ash, fluorite, fluorine compounds, and alkali metal and alkaline earth metal compounds may be added as fusion regulating agents, and carbon powder may be added as a melting speed regulating agent.

Mold powder is added at the surface of the molten steel inside the mold, and performs various functions as it is consumed. Major functions of mold powder include: (1) lubricating the mold and the solidified shell; (2) dissolving and absorbing inclusions; (3) insulation of the molten steel; and (4) controlling the speed of heat transfer. For (1) and (2), it is important to regulate the softening point and viscosity of the mold powder, and it is necessary to adjust the chemical composition of the mold powder accordingly. For (3), powder properties such as melting temperature, bulk specific density, and powder spreading, which can be regulated mainly by carbon powder, are considered to be important. For (4), it is important to regulate the crystallization temperature, etc., and it is necessary to adjust the chemical composition accordingly.

Worldwide technical progress in continuous casting of steel has been remarkable, and development continues. Moreover, Hot Charge Rolling (HC) and Hot Direct Rolling (HD) ratios have been improved and high-speed casting has been actively adopted to conserve energy, demands on mold powders have become stricter, and mold powders have become more diverse.

Thin-slab continuous casting has been developed from conventional continuous slab casting and applied with the objective of lower cost production with less heat transfer. There are still few such casters operating in Japan, but there are many operating widely mainly in the United States, but Europe, etc., as well, numbering several tens of units, and large numbers are being constructed in a large number of other countries.

There are several types of production processes in thin-slab continuous casting, including: (1) compact-strip-production (CSP) by SMS Schloemann-Siemag; (2) in-line-strip-production (ISP) by Mannesmann Demag; (3) Tippins Samsung process (TSP) by Tippins-Samsung; (4) flexible thin-slab rolling by Danieli; (5) continuous thin slab and rolling technique by Voest-Alpine Industrieanlagenbau (VAI); and (6) medium slabs (called medium but belonging to thin slabs from 100 mm) by Sumitomo Heavy Industries.

The main characteristic of the thin-slab continuous casting processes is that cast strips are directly hot rolled immediately, and even coiled. Consequently, finished and semi-finished products can be obtained in a matter of minutes from casting to coiling. In the case of conventional continuous casting of a generic slab, the process involves transferring the cast slab strip to a heating furnace and hot rolling it through a roughing-down mill, but in the case of thin-slab continuous casting, the process has a direct connection to the heating furnace and immediate rolling without roughing down in order to minimize the load on the rolling process. For that reason, thin-slab continuous casting is very-high-speed casting in which the casting speed is 3 or more meters per minute and the mold thickness is reduced.

Conventionally, Portland cement, phosphorus-containing slag, synthetic slag, wollastonite, dicalcium silicate, etc., are used as the principal raw materials for mold powders used in thin-slab continuous casting, carbonates such as $Na_2CO_3$, $Li_2CO_3$, $MgCO_3$, $CaCO_3$, $SrCO_3$, $MnCO_3$, and $BaCO_3$, as well as NaF, $Na_3AlF_6$, fluorite, $MgF_2$, LiF, borax, and spodumene, are used as fusion regulating agents, and carbonaceous raw materials are generally added as melting speed regulating agents.

On the other hand, mold powders employing synthetic calcium silicate as their principal raw material (semi-premelted types), and completely molten mold powders (premelted types) in which mold powder without carbon powder is first fused and pulverized to a suitable grain size, and then carbon powder is added, are also used as in the case of conventional generic slab casters.

Japanese Patent Laid-Open No. HEI 2-165853 discloses a high-speed continuous casting method for steel characterized in that its main components are CaO, $SiO_2$, and $Al_2O_3$, the ratio of CaO to $SiO_2$ (by weight percentage) is within a range of 0.5 to 0.95, it contains one or two or more species of oxides, carbonates, or fluorides of alkali metals, alkaline earth metals, or other metals, also contains carbon powder as a melting speed regulating agent, uses a mold powder whose surface tension at 1250° C. is 290 dyne/cm or more, whose solidifying temperature is 1000° C. or less, and in which a relationship between the viscosity η (poise) at 1300° C. and the casting speed V (m/min) satisfies a range represented by the expression:

$$3.5 \leqq \eta V \leqq 6.0,$$

and the caster operates at a casting speed $V \geqq 1.2$ m/min for a cast strip having a width of 600 mm or more. However, according to the preferred embodiments of the laid-open patent application in question, the casting speed is approximately 1.2 to 2.0 m/min, and it is clear this is not intended to be a very-high-speed continuous casting method with a casting speed of 3.0 m/min or more. Moreover, since the viscosity of conventional mold powders is too low for very-high-speed casting in which the casting speed is 3.0 m/min or more, heat transfer from the molten steel and the flow of fused powder between the solidified shell and the mold is not uniform, preventing achievement of stable quality and also preventing the achievement of stable operations. Therefore, the casting method described in the laid-open patent application in question and the very-high-speed continuous casting method of the present invention in which the casting speed would be 3.0 m/min or more are completely different casting methods.

At present, ordinary carbon steels such as ultra-low-carbon steels (carbon content: 100 ppm or less), low-carbon steels (carbon content: 0.02 to 0.07 wt %), medium-carbon steels (carbon content: 0.08 to 0.18 wt %), or high-carbon steels (carbon content: 0.18 wt % or more), and special steels such as stainless steel are being cast by thin-slab continuous casting. The characteristics of thin-slab continuous casting are that it is very-high-speed casting having a casting speed of approximately 3 to 8 m/min, and the mold thickness is reduced, as explained above. In addition, the molds in the casters of SMS, etc., have a special shape. That is because a submerged entry nozzle cannot be inserted since the mold thickness is very thin. For that reason, a portion called a "funnel" into which the submerged entry nozzle is inserted is widened and consequently the mold width is not straight but expands in the middle. For that reason, heat stress arises in the expanded funnel portion of the mold, and in addition, heat transfer is not uniform. Consequently, in the case of thin-slab continuous casting, a major problem has been that heat transfer is not uniform due to very-high-speed casting and surface crack occurs even in steel types such as ultra-low-carbon steel, low-carbon steel, or high-carbon steel in which the occurrence of surface crack is uncommon in conventional continuous slab casting. In the case of thin-slab continuous casting methods by other companies as well, heat transfer is not uniform due to very-high-speed casting and surface crack has similarly been a problem.

Furthermore, because it is very-high-speed casting, the molten surface level within the mold is unstable and varies greatly, and for that reason a problem has been that the powder slag gets into the molten steel at the meniscus, causing extreme deterioration in steel sheet quality.

In conventional continuous slab casting, methods which create a uniform solid shell by reducing heat transfer within the mold are effective in solving the surface crack mentioned above, and this is done by increasing the weight ratio of CaO to $SiO_2$ in the mold powder to raise its crystallization temperature. However, in very-high-speed casting exceeding 3 m/min, since raising the weight ratio of CaO to $SiO_2$ tends to increase friction between the mold and the solidified shell and lubrication by the mold powder deteriorates markedly, breakouts are more likely to occur instead, and so this measure cannot solve the above problem.

In other words, in thin-slab continuous casting, a mold powder has not yet been provided which reduces the likelihood of powder slag being entrapped in the mold without giving rise to surface crack, or which enables stable casting.

On the other hand, medium-carbon steels having a carbon content in a peritectic range of 0.10 to 0.16 weight percent could not be cast due to excessive heat transfer, ununiform flow of slag, etc., or initial solidification factors resulting from very-high-speed casting. Therefore, thin-slab continuous casting of medium-carbon steels having a carbon content in the peritectic range cannot be cast at present.

Consequently, an object of the present invention is to provide a mold powder which enables stable casting by reducing the likelihood of powder slag being entrapped in the mold without giving rise to surface crack when casting with a thin-slab continuous caster.

DISCLOSURE OF THE INVENTION

As a result of a series of various investigations aimed at solving the above problems, the present inventors have discovered a mold powder capable of overcoming all of the above defects.

More specifically, the present invention relates to a mold powder for thin-slab continuous casting of steel for use in methods for thin-slab continuous casting of steel in which casting speed is 3 m/min or greater, the mold powder for thin-slab continuous casting of steel being characterized in that:

a weight ratio of CaO to $SiO_2$ in the mold powder is within a range of 0.50 to 1.20;

the mold powder contains one or two or more species selected from a group consisting of oxides, carbonates, or fluorides of alkali metals, alkaline earth metals, or other metals, and 0.5 to 5 percent by weight of carbon powder;

$Li_2O$ content is within a range of 1 to 7 percent by weight;

Fluorine content is within a range of 0.5 to 8.0 percent by weight;

crystallization temperature is within a range of 1000 to 1200° C.;

surface tension at 1300° C. is 250 dyne/cm or more; and a relationship between viscosity η (poise) 1300° C. and casting speed V (m/min) satisfies a range represented by an expression:

$$6.0 \leqq \eta V \leqq 100.0.$$

In addition, the present invention relates to a mold powder for thin-slab continuous casting of medium-carbon steel for use in methods for thin-slab continuous casting of steel in which casting speed is 3 m/min or greater, the mold powder for thin-slab continuous casting of medium-carbon steel being characterized in that:

a weight ratio of CaO to $SiO_2$ in the mold powder is within a range of 0.70 to 1.20;

the mold powder contains one or two or more species selected from a group consisting of oxides, carbonates, or fluorides of alkali metals, alkaline earth metals, or other metals, and 0.5 to 5 percent by weight of carbon powder;

$Li_2O$ content is within a range of 1 to 7 percent by weight;

Fluorine content is within a range of 0.5 to 8.0 percent by weight;

crystallization temperature is within a range of 1050 to 1200° C.;

surface tension at 1300° C. is 250 dyne/cm or more; and a relationship between viscosity η (poise) 1300° C. And casting speed V (m/min) satisfies a range represented by an expression:

$$6.0 \leqq \eta V \leqq 85.0.$$

PREFERRED EMBODIMENTS OF THE INVENTION

As a result of a series of various investigations and research aimed at solving the above problems, the present inventors obtained the information given below.

As mentioned above, one problem has been that excessive heat transfer, non-uniformity, etc., occur as a result of very-high-speed casting, giving rise to surface crack defects and entrapment of the powder slag into the molten steel due to fluctuation of the molten surface level. With regard to the prevention of surface crack of the cast strip, this also cannot be solved by concentrating on the crystallization of the mold powder alone, which leads to the occurrence of breakouts, as explained above. However, it was found that this could be solved by adopting the following measures:

Heat transfer can be controlled by an air gap formed between the slag film and the mold. Consequently, it was found that by actively forming such an air gap, heat transfer can be reduced and mild cooling achieved, whereby the solidified shell forms uniformly and surface crack does not occur. To actively generate the air gap, the thickness of the slag film must be controlled, and it is consequently important to control the viscosity and consumption of the mold powder. In conventional high-speed casting of ordinary slabs, lubrication was considered to be important from the viewpoint of preventing breakouts, but in very-high-speed casting, the air gap is formed because the thickness of the slag film is reduced due to the high-viscosity of the mold powder, and the slag film on the solidified shell side adheres to the solidified shell and falls away. Consequently, heat transfer is controlled by setting the viscosity to a high level, and heat transfer is made uniform because the slag film is thin and therefore uniform. Furthermore, in the case of medium-carbon steel, heat transfer within the mold can be controlled together with the abovementioned air gap by controlling the crystallization temperature.

In addition, from the above viewpoint, if high viscosity is aimed for, the molten powder is less likely to be entrapped into the molten steel within the mold, making it more advantageous. Furthermore, it was found that friction between the mold and the solidified shell during very-high-speed casting is alleviated by the air gap formed between the slag film and the mold, providing further advantages against breakouts and surface crack.

Raising the viscosity of the mold powder in high-speed casting conditions used to lead to problems such as breakouts due to reduced consumption thereof. However, in very-high-speed casting at 3 m or more per minute, it was found that any reduction in consumption due to high viscosity alone was small. Falling away of the slag film is considered to be influenced by the speed of movement of the solidified shell, in other words, by the casting speed. Consequently, it was confirmed that stable casting operation is achieved even if the viscosity is increased to the degree mentioned above.

Next, the mold powder according to the present invention will be explained in detail.

It is preferable for the weight ratio of CaO to $SiO_2$ in the mold powder according to the present invention to be in a range of 0.5 to 1.20. It is not desirable for the weight ratio of CaO to $SiO_2$ to exceed 1.20 since the crystallization temperature exceeds 1200° C. And becomes too high, increasing the crystal phase, thereby increasing friction between the solidified shell and the powder slag film and giving rise to breakouts, or giving rise to lateral cracking which lowers the quality of the steel. Furthermore, it is not desirable for the weight ratio of CaO to $SiO_2$ to be less than 0.5 because crystallization trends are significantly weakened due to reduction of the crystallization temperature of the mold powder, making the thickness of the slag film nonuniform, and also making heat transfer nonuniform. Moreover, in the mold powder for medium-carbon steel, it is preferable for the weight ratio of CaO to $SiO_2$ to be in a range of 0.70 to 1.20. Here, as a mold powder for medium-carbon steel, it is not desirable for the weight ratio of CaO to $SiO_2$ to be less than 0.70 because the crystallization temperature falls below 1050° C., making the crystallized layer of the slag film thin and giving rise to surface crack in the cast strip because heat transfer occurs too quickly.

It is preferable for carbon powder to be proportioned at 0.5 to 5.0 percent by weight as a melting speed adjusting agent. It is not desirable from the standpoint of operations or quality for the proportion of carbon to be less than 0.5 percent by weight, because the slag formation reactions accelerate, and the thickness of the slag layer becomes too great, giving rise to slagbear patches. Furthermore, it is not desirable for the proportion of carbon to exceed 5 percent by weight, because the melting speed becomes too slow instead. Moreover, it is even more preferable for the proportion of carbon to be within a range of 0.5 to 4.5 percent by weight.

It was found that $Li_2O$ is an indispensable component for absorbing inclusions. That is to say, in very-high-speed casting such as thin-slab continuous casting, unless the meniscus flow speed is fast, inclusions are entrapped into the molten steel again. For that reason, it is important to increase the speed of inclusion absorption and the action of $Li_2O$ is effective at this. It is preferable for the content of $Li_2O$ is to be within a range of 1 to 7 percent by weight. It is not desirable for the $Li_2O$ content to be less than 1 percent by weight, because the effects at such proportions are too weak, and it is not desirable for the content to exceed 7 percent by weight because crystallization trends are weakened instead.

Fluorine content is extremely important in controlling crystallization of the mold powder, but it is not desirable for a large amount to be used, because the crystallization temperature becomes too high, and the crystallization temperature described below exceeds 1200° C. In addition, when the F content is greater than 8.0 percent by weight, erosion of the submerged entry nozzle becomes too great and corrosion of the continuous caster machine becomes greater, thereby also increasing poisoning. Consequently, it is preferable for the F content to be 0.5 to 0.8 percent by weight. Furthermore, it is not desirable for the F content to be less than 0.5 percent by weight because crystallization trends are weakened and surface tension increases markedly, and it is even more preferable for the F content to be within a range of 1.0 to 6.5 percent by weight.

The crystallization temperature of the mold powder is extremely useful in controlling heat transfer within the mold. However, as mentioned above, it is not desirable for a high crystallization temperature in excess of 1200° C. to be set, because friction between the solidified shell and the slag film increases and the frequency of surface crack and breakouts increases significantly. Furthermore, this is also not desirable from the aspects of deterioration in the quality of the cast strip or of stable operation because slagbear occur more easily due to the influence of variations in the molten surface during casting, and a crystallization temperature of 1000 to 1200° C. is preferable. On the other hand, it is not desirable for the crystallization temperature to be less than 1000° C. because adhesion between the slag film and the cast strand becomes strong, leading to defects in the cast strip if the slag film is pressed in by the rollers.

Furthermore, for a mold powder for medium-carbon steel, it is preferable for the crystallization temperature to be within a range of 1050 to 1200° C., and even more preferably 1050 to 1150° C. Here, it is not desirable for the crystallization temperature to be less than 1050° C. because the previously mentioned air gap formed between the slag film and the mold due to increased viscosity is reduced in size, giving rise to cracking of the cast strip. Nor is it desirable for the crystallization temperature to exceed 1200° C. because friction increases and there is a risk that cracking or breakouts will occur.

The surface tension of the mold powder is extremely important in preventing the powder entrapment in the steel. In thin-slab continuous casting in particular, being very-high-speed casting in excess of 3.0 m/min, the stream speed of the molten steel at the meniscus in the mold is fast, and for that reason the formation of powdery inclusions in the molten steel due to powder slag being scraped away by the flow of molten steel is significant and causes a large defect in coil quality. Because eddy currents are generated in the vicinity of the submerged entry nozzle by this meniscus molten steel, coil quality similarly deteriorates due to the mixing in of powder slag. Consequently, the reduction of powder inclusions is important in improving coil quality. It was found that defects due to powder inclusions are significantly reduced if the surface tension is set to 250 dyne/cm or more. Consequently, it is important to adjust the surface tension of the mold powder and to maintain it at 250 dyne/cm or more at a temperature of 1300° C. However, it is preferable for the surface tension to be within a range of 250 to 500 dyne/cm because the temperature of the thermocouple for the breakout detection becomes irregular if the surface tension exceeds 500 dyne/cm, giving rise to situations in which the breakout warning alarm malfunctions.

The viscosity of the mold powder is important from the aspects of operations and quality. As mentioned above, one problem has been that cracking of the cast strip occurs in thin-slab continuous casting methods even with steel types in which cracking does not occur in conventional continuous slab casting methods. Conventional mold powders have tended to achieve low heat transfer within the mold by setting a high crystallization temperature, which instead not only caused deterioration in the quality of the cast strip but was also disadvantageous from the operations standpoint because of the occurrence of breakouts and the like. It was found that low heat transfer within the mold can be achieved, without affecting stable operations, by forming an air gap between the slag film and the mold. For this purpose, it is important to control slag film thickness, which can be achieved by adjusting viscosity.

In the case of conventional thin-slab continuous casting, the mold powders used give priority to stable operations, ensure consumption thereof, or give priority to lubrication. However, in the mold powder according to the present invention, viscosity is significantly higher than conventional products in order to control heat transfer by controlling the slab film thickness as explained above. The viscosity of the mold powder according to the present invention at 1300° C. is within a range of 1.5 to 20 poise, preferably 2 to 20 poise, and even more preferably 2.5 to 20 poise. To control heat transfer within the mold, it is important to incorporate the relationship between casting speed and viscosity into the design. As a result of a series of various investigations, the present inventors have discovered that it is important to ensure that viscosity satisfies a relationship $$6.0 \leqq \eta V \leqq 100.0$$

in order to establish both quality of the cast strip and stable operations in thin-slab continuous casting. Here, $\eta$ is the viscosity in poise of the mold powder at 1300° C. V indicates the casting speed in meters per minute (m/min).

It is not desirable for this upper limit to be exceeded because friction increases between the solidified shell and the mold giving rise to cracking of the cast strip and breakouts instead. On the other hand, it is not desirable to fall below the lower limit because ununiform flow increases. Consequently, it is important to satisfy the above expression.

For a mold powder for a medium-carbon steel according to the present invention, it is important to ensure that viscosity satisfies a relationship $$6.0 \leqq \eta V \leqq 85.0$$

in order to establish both quality of the cast strip and stable operations in thin-slab continuous casting.

Metal can be added to the mold powder according to the present invention to make it into a exothermic mold powder. In that case, it is preferable to use less than 6 percent by weight because when more than 6 percent by weight is added, slag formation time is delayed significantly.

The mold powder used can be made into granules having 90 percent by weight or more of grains having a diameter of less than 1.5 mm. It is not desirable for the content of grains with a diameter of less than 1.5 mm to be less than 90 percent by weight because the heat insulation characteristics of the mold powder decrease significantly and deckel and slagbear patches form.

The above-mentioned granulated products can be granulated by any common granulation method such as extrusion granulation, agitation granulation, flow granulation, roll granulation, spray granulation, etc. In addition, a wide range of binders can be used, from organic types such as common starch to inorganic types such as water glass.

The mold powder for thin-slab continuous casting of steel according to the present invention will now be explained further using Examples.

EXAMPLE 1

Table 1 below shows mixing ratios, chemical composition, and physical property values for inventive products and comparative products. For these inventive products and comparative products, five to twenty charges each of ultra-low-carbon steels (ULC; carbon content: 30 to 60 ppm), low-carbon steels (LC; carbon content: 0.04 to 0.06 wt %), medium-carbon steels (MC; carbon content: 0.18 wt %), and high-carbon steels (HC; carbon content: 0.25 to 1 wt %) were used, and the results are given in Table 2. Thin-slab continuous casting was performed at 3.0 to 8.0 m/min and assessed.

TABLE 1

| | Chemical composition (wt %) | | | | | | | | | | | | | | | |
|---|---|---|---|---|---|---|---|---|---|---|---|---|---|---|---|---|
| Powder No. | $SiO_2$ | $Al_2O_3$ | CaO | MgO | $Na_2O$ | $Li_2O$ | F | $TiO_2$ | MnO | SrO | $B_2O_3$ | Total Carbon | $CaO/SiO_2$ wt. ratio | viscosity 1300° C. (poise) | Crystalizing temp. (° C.) | Surface tension (dyn/cm) |
| | | | | | | | | | Present invention | | | | | | | |
| 1 | 41.4 | 7.6 | 27.0 | 2.8 | 7.1 | 3.9 | 5.8 | | | | | 4.4 | 0.65 | 5.0 | 1005 | 260 |
| 2 | 39.4 | 7.1 | 31.9 | 4.3 | 6.5 | 1.8 | 5.9 | | | | | 3.1 | 0.81 | 3.1 | 1035 | 280 |
| 3 | 38.5 | 5.9 | 36.3 | 4.0 | 4.7 | 1.6 | 5.7 | | | | | 3.3 | 0.94 | 2.5 | 1085 | 300 |
| 4 | 40.5 | 5.7 | 39.3 | 0.8 | 2.5 | 6.9 | 2.5 | | | | | 2.0 | 0.98 | 1.8 | 1050 | 425 |
| 5 | 35.9 | 5.3 | 42.1 | 0.5 | 5.1 | 2.0 | 6.1 | | | | | 3.0 | 1.17 | 1.8 | 1185 | 360 |
| 6 | 40.2 | 6.5 | 33.6 | 3.2 | 5.0 | 5.0 | 3.8 | | | | | 2.7 | 0.84 | 2.7 | 1060 | 340 |
| 7 | 37.8 | 5.9 | 34.6 | 3.9 | 4.6 | 3.4 | 5.9 | | | | | 3.9 | 0.92 | 2.0 | 1045 | 360 |
| 8 | 37.4 | 6.9 | 40.5 | 0.9 | 2.8 | 2.9 | 5.5 | | | | | 3.0 | 1.08 | 2.5 | 1150 | 450 |
| 9 | 41.6 | 6.2 | 35.1 | 0.5 | 6.5 | 3.4 | 5.8 | | | | | 0.9 | 0.84 | 3.0 | 1025 | 325 |
| 10 | 43.4 | 7.3 | 32.8 | 0.6 | 7.5 | 2.9 | 5.0 | | | | | 0.5 | 0.76 | 6.0 | 1040 | 285 |
| 11 | 34.6 | 6.4 | 40.2 | 0.7 | 6.0 | 2.0 | 5.0 | | 1.6 | | | 3.5 | 1.16 | 2.0 | 1195 | 360 |
| 12 | 40.4 | 6.7 | 34.5 | 0.7 | 6.3 | 2.1 | 5.4 | | | 0.5 | 0.5 | 2.9 | 0.85 | 4.0 | 1110 | 390 |

TABLE 1-continued

| Powder No. | Chemical composition (wt %) $SiO_2$ | $Al_2O_3$ | CaO | MgO | $Na_2O$ | $Li_2O$ | F | $TiO_2$ | MnO | SrO | $B_2O_3$ | Total Carbon | $CaO/SiO_2$ wt. ratio | viscosity 1300° C. (poise) | Crystalizing temp. (° C.) | Surface tension (dyn/cm) |
|---|---|---|---|---|---|---|---|---|---|---|---|---|---|---|---|---|
| 13 | 40.7 | 6.8 | 34.8 | 0.8 | 3.3 | 6.6 | 2.2 | 1.0 | | 0.5 | 0.5 | 2.8 | 1.86 | 3.5 | 1040 | 350 |
| 14 | 45.9 | 8.9 | 34.4 | 0.5 | 0.5 | 4.3 | 0.6 | | | | | 4.9 | 0.75 | 10.0 | 1000 | 480 |
| 15 | 51.2 | 9.6 | 28.2 | 0.2 | 0.2 | 5.9 | 0.5 | | | | | 4.2 | 0.55 | 18.0 | 1000 | 490 |
| Comparison | | | | | | | | | | | | | | | | |
| 1 | 33.7 | 4.6 | 31.2 | 5.2 | 10.5 | 3.4 | 8.4 | | | | | 3.0 | 0.93 | 0.7 | 980 | 220 |
| 2 | 31.9 | 3.2 | 39.1 | 1.6 | 9.1 | 2.7 | 9.2 | | | | | 3.2 | 1.23 | 0.5 | 1210 | 200 |

In Table 1, synthetic calcium silicate with a $CaO/SiO_2$ weight ratio equal to 1.10 was used as the main raw material for Inventive Products 1, 2, 3, 4, 6, 7, 9, 10, and 12 to 15 and Comparative Product 1, and synthetic calcium silicate with a $CaO/SiO_2$ weight ratio equal to 1.35 was used for the rest. Furthermore, glass powder, diatomaceous earth, and spodumene were used as the $SiO_2$ materials in the mold powder in all cases in Table 1. In addition, $Na_2CO_3$, $Li_2CO_3$, $MnCO_3$, $SrCO_3$, NaF, $Na_3AlF_6$, $CaF_2$, $Al_2O_3$, MgO, LiF, $TiO_2$, $ZrO_2$, and $B_2O_3$ used as flux materials were adjusted and proportioned to make the chemical compositions given in Table 1 and mixed using a mixer. Moreover, carbon black and coke powder were used for the carbon source in all of the mold powders, being added to make the chemical compositions given in Table 1. Furthermore, 2.8 percent by weight of metal Si was added to Inventive Product 9 and 4.4 percent by weight of metal Ca—Si alloy was added to Inventive Product 10, and mixed similarly. In addition, Inventive Product 7 was a granulated product in which 20 to 30 percent by weight of a solvent composed of 90 percent by weight of water and 10 percent by weight of sodium silicate was added to the mixture to form a slurry which was spray granulated and dried. In Inventive Product 8, 10 to 16 percent by weight of a solvent composed of 95 percent by weight of water and 5 percent by weight of starch paste was added to the mixture agitation granulated and dried.

TABLE 2

| Powder No. | Kind of steel | Casting rate | Break-outs | Pin-hole | crack | Powdery inclusions |
|---|---|---|---|---|---|---|
| Present invention | | | | | | |
| 1 | H.C | 3.5 | Δ | ○ | Δ | ○ |
| 2 | L.C | 5.5 | ○ | ○ | ○ | ○ |
| 3 | L.C | 7.0 | ○ | ○ | ○ | ○ |
| 4 | U.L.C | 8.0 | ○ | Δ | ○ | Δ |
| 5 | M.C | 6.0 | ○ | ○ | ○ | Δ |
| 6 | ULC & LC | 5.0 | ○ | ○ | ○ | ○ |
| 7 | L.C | 7.0 | ○ | ○ | ○ | ○ |
| 8 | M.C | 5.0 | ○ | ○ | Δ | ○ |
| 9 | L.C | 6.0 | ○ | ○ | ○ | ○ |
| 10 | UL.C & HC | 3.0 | ○ | ○ | ○ | ○ |
| 11 | M.C | 6.0 | ○ | Δ | ○ | ○ |

TABLE 2-continued

| Powder No. | Kind of steel | Casting rate | Break-outs | Pin-hole | crack | Powdery inclusions |
|---|---|---|---|---|---|---|
| 12 | L.C | 4.0 | ○ | Δ | ○ | ○ |
| 13 | U.L.C | 5.0 | Δ | ○ | ○ | ○ |
| 14 | L.C | 5.0 | ○ | ○ | ○ | ○ |
| 15 | L.C | 5.5 | Δ | ○ | ○ | ○ |
| Comparison | | | | | | |
| 1 | LC & ULC | 6.0 | × | × | × | × |
| 2 | M.C | 4.0 | × | Δ | Δ | × |

In the results shown in Table 2, for breakouts ○ indicates no occurrence, Δ indicates only one occurrence, and X indicates two or more occurrences. For powder inclusions, ○ indicates that the proportion defective was 0%, Δ indicates up to 1%, and X indicates greater than 1% or more. For pin holes and cracking, ○ indicates no occurrence, Δ indicates one per $m^2$, and X indicates two or more occurrences per $m^2$.

EXAMPLE 2

Table 3 below shows mixing ratios, chemical composition, and physical property values for inventive products and comparative products. For these inventive products and comparative products, four to twenty charges each of sub-peritectic medium-carbon steels (carbon content: 0.08 to 0.15 wt %) were used, and the results are given in Table 4. Thin-slab continuous casting was performed at 3.0 to 8.0 m/min and assessed.

TABLE 3

| Powder No. | Chemical composition (wt %) $SiO_2$ | $Al_2O_3$ | CaO | MgO | $Na_2O$ | $Li_2O$ | F | $TiO_2$ | MnO | ZrO | Total Carbon | $CaO/SiO_2$ wt. ratio | viscosity 1300° C. (poise) | Crystalizing temp. (° C.) | Surface tension (dyn/cm) |
|---|---|---|---|---|---|---|---|---|---|---|---|---|---|---|---|
| | | | | | | | | Present invention | | | | | | | |
| 16 | 38.1 | 5.4 | 39.0 | 1.0 | 4.9 | 1.0 | 7.5 | | | | 3.1 | 1.03 | 2.5 | 1110 | 340 |
| 17 | 36.8 | 6.1 | 40.6 | 0.8 | 4.7 | 1.1 | 7.0 | | | | 2.9 | 1.10 | 2.0 | 1150 | 345 |
| 18 | 36.9 | 6.7 | 40.9 | 0.8 | 4.7 | 2.4 | 4.5 | | | | 3.1 | 1.11 | 2.7 | 1130 | 390 |
| 19 | 35.2 | 7.0 | 41.7 | 0.7 | 4.8 | 1.9 | 4.8 | | | | 3.9 | 1.18 | 2.5 | 1185 | 400 |
| 20 | 37.4 | 6.8 | 41.7 | 0.8 | 4.8 | 1.9 | 2.8 | | | | 3.8 | 1.12 | 3.7 | 1190 | 450 |
| 21 | 37.4 | 4.2 | 39.8 | 0.8 | 6.2 | 3.4 | 4.8 | | | | 3.4 | 1.06 | 1.7 | 1150 | 370 |
| 22 | 37.6 | 6.7 | 40.5 | 0.8 | 4.4 | 2.0 | 5.9 | | | | 2.1 | 1.08 | 2.8 | 1140 | 375 |
| 23 | 36.5 | 6.8 | 41.5 | 2.0 | 4.4 | 2.1 | 4.7 | | | | 2.0 | 1.14 | 2.5 | 1170 | 390 |
| 24 | 40.3 | 6.7 | 40.8 | 1.9 | 4.3 | 2.4 | 2.8 | | | | 0.8 | 1.01 | 4.2 | 1130 | 410 |
| 25 | 38.1 | 6.4 | 44.6 | 1.8 | 4.5 | 1.8 | 1.8 | | | | 0.9 | 1.17 | 3.8 | 1190 | 380 |
| 26 | 36.3 | 5.1 | 41.9 | 1.7 | 4.3 | 1.7 | 5.1 | 0.9 | 0.9 | | 2.1 | 1.15 | 2.0 | 1180 | 320 |
| 27 | 38.0 | 5.0 | 40.9 | 0.7 | 4.2 | 1.7 | 5.0 | | 2.0 | 0.8 | 2.4 | 1.08 | 2.8 | 1170 | 345 |
| 28 | 47.3 | 8.7 | 33.6 | 0.8 | 0.5 | 4.2 | 0.5 | | | | 4.4 | 0.71 | 10.0 | 1050 | 450 |
| 29 | 46.8 | 9.9 | 35.6 | 0.2 | 0.1 | 4.7 | 0.5 | | | | 2.2 | 0.76 | 15.0 | 1060 | 460 |
| 30 | 41.1 | 9.8 | 40.2 | 0.8 | 0.6 | 3.6 | 1.0 | | | | 4.2 | 0.98 | 9.0 | 1030 | 490 |
| | | | | | | | | Comparison | | | | | | | |
| 3 | 40.8 | 4.8 | 38.4 | 1.6 | 4.0 | 2.8 | 5.6 | | | | 3.0 | 0.94 | 2.8 | 970 | 300 |
| 4 | 36.1 | 5.2 | 44.4 | 1.7 | 4.4 | 1.2 | 4.5 | | | | 3.5 | 1.23 | 2.1 | 1215 | 260 |
| 5 | 33.2 | 3.6 | 40.8 | 0.6 | 8.0 | 1.6 | 9.2 | | | | 3.0 | 1.23 | 0.6 | 1190 | 240 |

In Table 3, synthetic calcium silicate with a $CaO/SiO_2$ weight ratio equal to 1.35 was used as the main raw material for Inventive Products 19, 20, 24, and 25, and synthetic calcium silicate with a $CaO/SiO_2$ weight ratio equal to 1.10 was used for the rest. Furthermore, glass powder, diatomaceous earth, and spodumene were used as the $SiO_2$ materials in the mold powder in all cases in Table 3.

In addition, $Na_2CO_3$, $Li_2CO_3$, $MnCO_3$, $SrCO_3$, NaF, $Na_3AlF_6$, $CaF_2$, $Al_2O_3$, MgO, LiF, $TiO_2$, $ZrO_2$, and $B_2O_3$ used as flux materials were adjusted and proportioned to make the chemical compositions given in Table 3 and mixed using a mixer. Moreover, carbon black and coke powder were used for the carbon source in all of the mold powders, being added to make the chemical compositions given in Table 3. Furthermore, 2.5 percent by weight of metal Si was added to Inventive Product 24 and 4.4 percent by weight of metal Ca—Si alloy was added to Inventive Product 25, and mixed similarly.

In addition, Inventive Product 22 was a granulated product in which 20 to 30 percent by weight of a solvent composed of 90 percent by weight of water and 10 percent by weight of sodium silicate was added to the mixture to form a slurry which was spray granulated and dried. In Inventive Product 24, 10 to 16 percent by weight of a solvent composed of 95 percent by weight of water and 5 percent by weight of starch paste was added to the mixture agitation granulated and dried.

TABLE 4

| Powder No. | Casting rate | Breakouts | Pinhole | crack | Powdery inclusions |
|---|---|---|---|---|---|
| | | Present Invention | | | |
| 16 | 5.0 | ○ | ○ | Δ | ○ |
| 17 | 7.5 | ○ | ○ | ○ | ○ |
| 18 | 4.5 | ○ | ○ | ○ | ○ |
| 19 | 4.0 | ○ | Δ | ○ | ○ |
| 20 | 3.5 | ○ | ○ | ○ | ○ |

TABLE 4-continued

| Powder No. | Casting rate | Breakouts | Pinhole | crack | Powdery inclusions |
|---|---|---|---|---|---|
| 21 | 8.0 | ○ | ○ | ○ | Δ |
| 22 | 5.0 | ○ | ○ | ○ | ○ |
| 23 | 4.0 | ○ | ○ | ○ | ○ |
| 24 | 3.0 | ○ | ○ | Δ | ○ |
| 25 | 3.5 | ○ | ○ | ○ | ○ |
| 26 | 6.0 | ○ | Δ | ○ | ○ |
| 27 | 5.0 | ○ | Δ | ○ | ○ |
| 28 | 5.5 | ○ | Δ | ○ | ○ |
| 29 | 5.0 | ○ | ○ | Δ | ○ |
| 30 | 6.0 | ○ | ○ | ○ | ○ |
| | | Comparison | | | |
| 3 | 5.0 | × | × | × | × |
| 4 | 6.0 | × | × | Δ | × |
| 5 | 4.5 | × | × | × | × |

In the results shown in Table 4, for breakouts ○ indicates no occurrence, Δ indicates only one occurrence, and X indicates two or more occurrences. For powder inclusions, ○ indicates that the proportion defective was 0%, Δ indicates up to 1%, and X indicates greater than 1% or more. For pin holes and cracking, ○ indicates no occurrence, Δ indicates one per $m^2$, and X indicates or more occurrences per $m^2$.

Possibility of Use in Industry

The present invention exhibits the effect that a mold powder can be provided which enables stable casting by reducing the likelihood of powder entrapment into the mold without giving rise to surface crack in the cast strip when casting with a thin-slab continuous caster.

What is claimed is:

1. A mold powder for thin-slab continuous casting of steel comprising a weight ratio of CaO to $SiO_2$ in said mold powder is within a range of 0.50 to 1.20;

said mold powder contains one or more species selected from the group consisting of oxides, carbonates, or fluorides of alkali metals, alkaline earth metals and metals selected from the group consisting of Mn, Al, Mg, Ti, Zr and B, and 0.5 to 5 percent by weight of carbon powder;

$Li_2O$ content is within a range of 1 to 7 percent by weight;

Fluorine content is within a range of 0.5 to 8.0 percent by weight;

crystallization temperature is within a range of 1000° C. to 1200° C.;

surface tension at 1300° C. is 250 dyne/cm or more; and a relationship between viscosity η (poise) at 1300° C. and casting speed V (m/min) satisfies a range represented by an expression:

$$6.0 \leqq \eta v \leqq 100.0.$$

2. The mold powder according to claim 1 containing 6 percent by weight or less of metal powder or alloy powder.

3. The mold powder according to claim 1 being granules having 90 percent by weight or more of grains having a diameter of less than 1.5 mm.

4. A mold powder for thin-slab continuous casting of medium-carbon steel comprising:

a weight ratio of CaO to $SiO_2$ in said mold powder is within a range of 0.70 to 1.20;

said mold powder contains one or more species selected from the group consisting of oxides, carbonates, or fluorides of alkali metals, alkaline earth metals, and metals selected from the group consisting of Mn, Al, Mg, Ti, Zr and B, and 0.5 to 5 percent by weight of carbon powder;

$Li_2O$ content is within a range of 1 to 7 percent by weight;

Fluorine content is within a range of 0.5 to 8.0 percent by weight;

crystallization temperature is within a range of 1050° C. to 1200° C.;

surface tension at 1300° C. is 250 dyne/cm or more; and a relationship between viscosity η (poise) at 1300° C. and casting speed V (m/min) satisfies a ran a represented by an expression:

$$6.0 \leqq \eta v \leqq 85.0.$$

5. The mold powder according to claim 4 wherein carbon content in said medium-carbon steel is within a range of 0.08 to 0.18 percent by weight.

6. The mold powder according to claim 4 containing 6 percent by weight or less of metal powder or alloy powder.

7. The mold powder according to claim 4 being granules having 90 percent by weight or more of grains having a diameter of less than 1.5 mm.

8. The mold powder according to claim 1 wherein said carbon powder is within a range of 0.5 to 4.5 percent by weight.

9. The mold powder according to claim 4, wherein said carbon powder is within a range of 0.5 to 4.5 percent by weight.

10. The mold powder according to claim 1, wherein said Fluorine content is within a range of 1.0 to 6.5 percent by weight.

11. The mold powder according to claim 4, wherein said Fluorine content is within a range of 1.0 to 6.5 percent by weight.

12. The mold powder according to claim 4, wherein said crystallization temperature is within a range of 1050° C. to 1150° C.

13. The mold powder according to claim 1 wherein said surface tension at 1300° C. is within a range of 250 to 500 dyne/cm.

14. The mold powder according to claim 4, wherein said surface tension at 1300° C. is within a range of 250 to 500 dynes/cm.

* * * * *